US006464388B2

(12) United States Patent
Ligouzat

(10) Patent No.: US 6,464,388 B2
(45) Date of Patent: Oct. 15, 2002

(54) MIXER INCORPORATING IMBALANCE

(75) Inventor: Jean-Philippe Ligouzat, Noisy le Roi (FR)

(73) Assignee: Pari, Rueil Malmaison (FR)

( * ) Notice: Subject to any disclaimer, the term of this patent is extended or adjusted under 35 U.S.C. 154(b) by 0 days.

(21) Appl. No.: 10/003,804

(22) Filed: Nov. 2, 2001

(65) Prior Publication Data

US 2002/0054538 A1 May 9, 2002

(30) Foreign Application Priority Data

Nov. 3, 2000 (FR) ..... 00 14106

(51) Int. Cl.[7] ..... B01F 7/08
(52) U.S. Cl. ..... 366/319; 198/670
(58) Field of Search ..... 366/64, 66, 96–99, 366/117–118, 156.1–158.4, 186, 318–320, 322, 324; 222/412–413; 198/657, 670, 676

(56) References Cited

U.S. PATENT DOCUMENTS 3,282,055 A * 11/1966 Landau
3,381,801 A * 5/1968 Rastoin
3,481,512 A * 12/1969 Scheffer et al.
5,524,796 A * 6/1996 Hyer

FOREIGN PATENT DOCUMENTS

FR 2414952 * 8/1979
FR 2443277 * 7/1980

* cited by examiner

*Primary Examiner*—Charles E. Cooley
(74) *Attorney, Agent, or Firm*—Weingarten, Schurgin, Gagnebin & Lebovici LLP

(57) ABSTRACT

A device for continuously mixing liquid products and/or pulverized products. The device includes at least one outer tubular casing, a mechanism for supplying products to be mixed disposed at a first end of the tubular casing, the second end of the tubular casing being open for the discharge of the mixture, a mixer member having the form of a helix of inner diameter D disposed inside the tubular casing, and a mechanism for rotating the mixer member about the axis of the tubular casing. The device further includes an elongated piece closed at its two ends, of diameter d, with d<D, and of length l less than the length L of the mixer member, the piece being mounted free inside the mixer member, and a mechanism for axially holding the cylindrical piece inside the mixer member.

9 Claims, 2 Drawing Sheets

MIXER INCORPORATING IMBALANCE

FIELD OF THE INVENTION

The present invention relates to a device for continuously mixing liquid products and/or pulverulent products.

BACKGROUND OF THE INVENTION

Devices for mixing liquid products and/or pulverulent products are well known. In particular, they are described in French Patent No. 2 414 952 and its Certificate of Addition No. 2 443 277.

In its most simple form, shown for example in accompanying FIG. 1, such a device comprises an outer tubular casing 10 presenting an open end 12 for the discharge of the mixture and an open end 14 for the infeed of one of the products to be mixed. Reference 16 designates the system of infeed of the second product to be mixed. Inside the tubular casing 10 is located a rotating mixer member 18 which is in the form of a helix extending over a large part of the length of the tubular casing. The mixer member 18 is driven in rotation about axis x',x' of the tubular casing by a motor 20. Rotation of the helix 18 ensures both the mixture of the liquid and/or pulverulent products, and the entrainment of the mixture produced towards the discharge end 12.

When this type of mixer is used for products which are hygroscopic, adhesive, clogging or hardening, caking occurs inside the helix 18 upon encountering the products to be mixed. This effect of caking on the helix 18 alters the efficiency of the mixture by the helix 18 and can therefore entrain to the outlet of the mixer a finished product which is non-homogeneous or even lumpy.

Document U.S. Pat. No. 3,381,801 describes a tubular device for conveying pulverized products. This device comprises a spiral element and an axial tubular bar mounted inside the spiral. One end of the bar is fast with the tubular casing of the device and this bar extends over the whole length of the path of the pulverized products in order to limit the free volume for the pulverized product. Such a device can in no way solve the problem raised.

It is an object of the present invention to provide a device for mixing liquid products and/or pulverized products which avoids the risks of the mixture caking on the helix of the mixer, without decreasing the efficiency of the mixer nor reducing its flowrate.

SUMMARY OF THE INVENTION

To attain that object, the device according to the invention for continuously mixing liquid products and/or pulverized products, comprising at least one outer tubular casing, means for supplying products to be mixed disposed at a first end of the tubular casing, the second end of the tubular casing being open for the discharge of the mixture, a mixer member having the form of a helix of inner diameter D disposed inside the tubular casing, and means for rotating the mixer member about the axis of said tubular casing, further comprises an elongated piece closed at its two ends, of diameter d, with d<D, and of length l less than the length L of the mixer member, said piece being mounted radially free inside the mixer member and being radially free with respect to said outer tubular casing to form an imbalance, and means for axially holding said cylindrical piece inside the mixer member.

It will be understood that the cylindrical elongated piece which is mounted free inside the turn forming mixer member, i.e. without any mechanical link between the elongated piece and the mixer, constitutes the equivalent of an imbalance. Due to the rotation of the helix and the absence of mechanical link, the cylindrical piece hits the inner face of the turns of the helix, preventing caking of the mixture or causing any caking to be detached from the helix. In addition, it will be understood that the cylindrical piece is immobilized in translation, on the one hand, by the holding means disposed at the discharge end of the mixer and, on the other hand, by the effect of the products to be mixed entrained by the mixer member.

It goes without saying that, depending on the nature of the products to be mixed, the elongated piece mounted free in the mixer member will have different dimensions and suitable weights.

The ends of the elongated piece are preferably shaped.

BRIEF DESCRIPTION OF THE DRAWINGS

The invention will be more readily understood on reading the following description of two forms of embodiment of the invention given by way of non-limiting examples, with reference to the accompanying drawings, in which.

DESCRIPTION OF PREFERRED EMBODIMENTS

Figure 1:
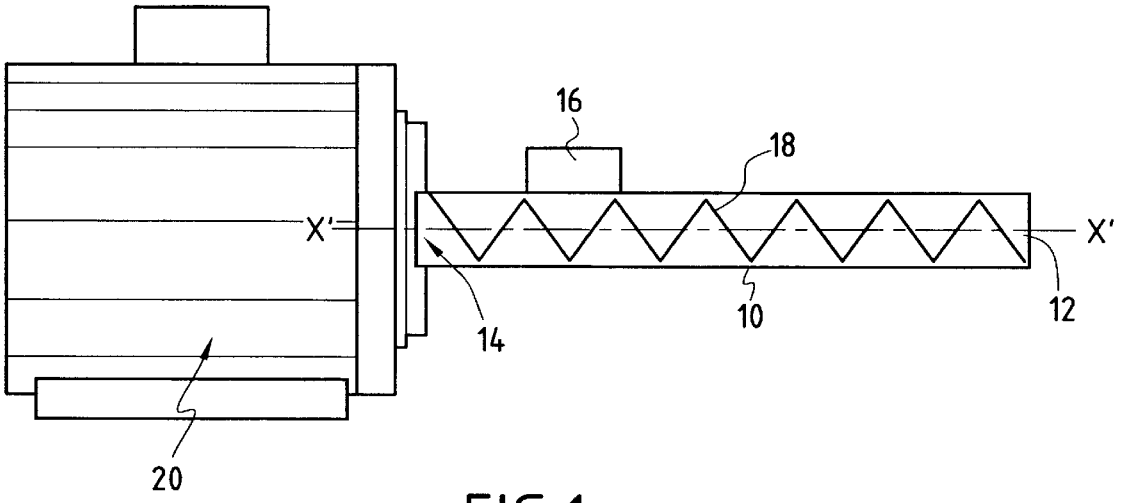
FIG.1 PRIOR ART
FIG. 1, to which reference has already been made, shows a mixer of known type.
Figure 2:
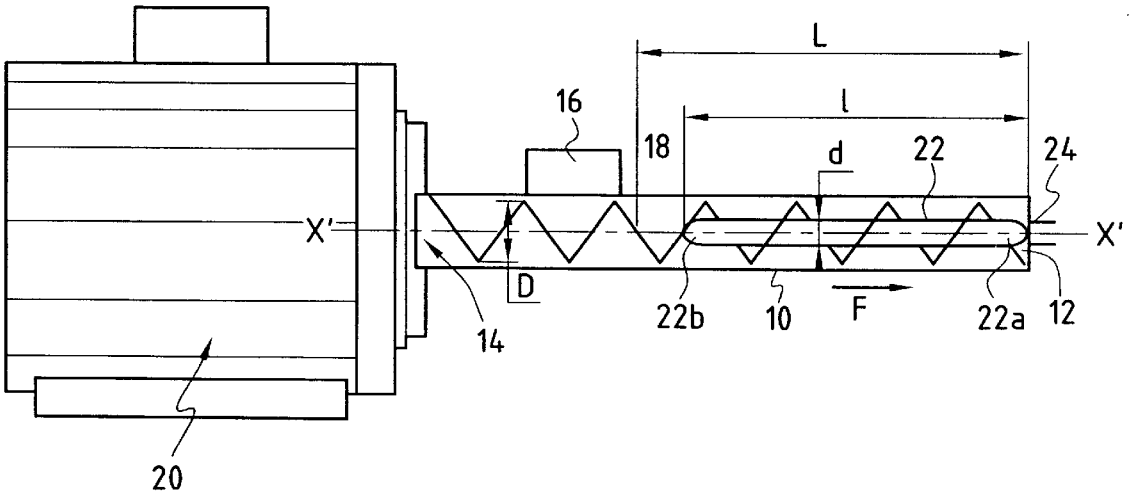
FIG. 2 shows, in longitudinal section, a first form of embodiment of a mixer according to the invention.

Referring again to the drawings, FIG. 2 shows a first form of embodiment of the mixer according to the invention. It presents the constituent elements described with reference to FIG. 1 and this part of the mixer will therefore not be described.

According to an essential characteristic of the invention, the mixer comprises, in addition to the elements already described in connection with FIG. 1, an elongated piece 22, preferably substantially cylindrical in shape, which is mounted free inside the mixer member 18 in the form of a helix. In particular, it can move freely inside the helix in the radial directions thereof. The elongated piece 12 is closed at its two ends 22*a* and 22*b*. It presents a length l and a diameter d. In addition, in the vicinity of the discharge end 12 of the mixer and at the end 18*a* of the mixer helix 18, there is provided a device for axially holding the elongated piece 22. This device 24 may be a perforated plate disposed across the tubular casing 10 so that it allows the mixture to pass, but retains the elongated piece 22 by its end 22*b*.

It will be understood that, as the piece 22 is mounted radially free inside the helix 18, this piece will behave like an imbalance inside the helix 18. The radial movements of the piece 22, due in particular to the fact that the piece 22 is rotated on itself by the rotation of the helix, will cause it to hit the inner face of the helix 18 at random, which partly avoids caking of the mixture on the helix or which makes it possible to detach the caking from the helix should such caking already have begun to form. It will also be understood that the piece 22 is held inside the helix 18 beyond the zone 16 of infeed of one of the products to be mixed. In effect, by reason of the advance of the products to be mixed under the effect of the rotation of the mixer member 18, the piece 22 undergoes a force F which tends to cause it to move towards the discharge end 12 of the tube and, in antagonistic manner, the piece 22 is retained by the holding member 24. In this way, the piece 22 is entirely free inside the helix 18 in the radial directions thereof and it is held only by the holding member 24 in the longitudinal direction without, however, being mechanically connected to this member.

The length l of the piece 22 is such that said piece 22 is entirely disposed between the zone 16 of infeed of one of the products to be mixed and the end of the turn 18. Its diameter d depends, of course, on the inner diameter D of the helix 18 and also on the nature of the products to be mixed. In the case of products which risk forming lumps, a diameter d of low value will be chosen so that the piece 22, behaving like an imbalance, beats the helix and the material to be mixed to a maximum and crushes the lumps in the mixer. The diameter d also depends on the viscosity of the products to be mixed. The higher the viscosity, the smaller the diameter d will be in order to avoid the mixer blocking. The clearance between the inner face of the helix when the latter has a diameter of 100 mm and the piece 22, will lie between 5 mm and 20 mm on the radius. In other words, the total clearance lies between 10 mm and 40 mm. More generally, this clearance is included between 10 and 50% of the inner diameter D of the helix 18, i.e. the diameter d of the piece 22 is included between 90% of D and 50% of D.

The weight of piece 22 must also be adapted to the nature of the materials to be mixed. Generally, the piece 22 will be made as light as possible. For example, for a helix with an inner diameter of 100 mm, its weight will vary from 500 g to 1500 g. The more the product is viscous, the greater the weight, in order to maintain the phenomenon of imbalance. On the other hand, the less the product is viscous, the lighter the weight of the piece 22, in order to avoid the introduction of phenomena of vibrations.

The ends 22*a* and 22*b* of the piece 22 are preferably shaped in order to improve flow of the mixture. They may taken the shape of a cone or an ogive.

The piece 22 is advantageously made of a supple and light material such as plastics materials and/or composite materials in order to avoid too great shocks between the piece 22 and the mixer helix 18 and to prevent the creation of vibrations in the whole of the device.

The piece 22 preferably presents a substantially circular cross-section. However, this cross-section may be a polygon in order that the piece 22 presents edges capable, in certain cases, of promoting the action on the cakings. The piece 22 may also be equipped with a helix on its outer face, whose pitch is opposite that of the mixer helix 18. Such an arrangement promotes the mixture of the products to be mixed.

Figure 3:
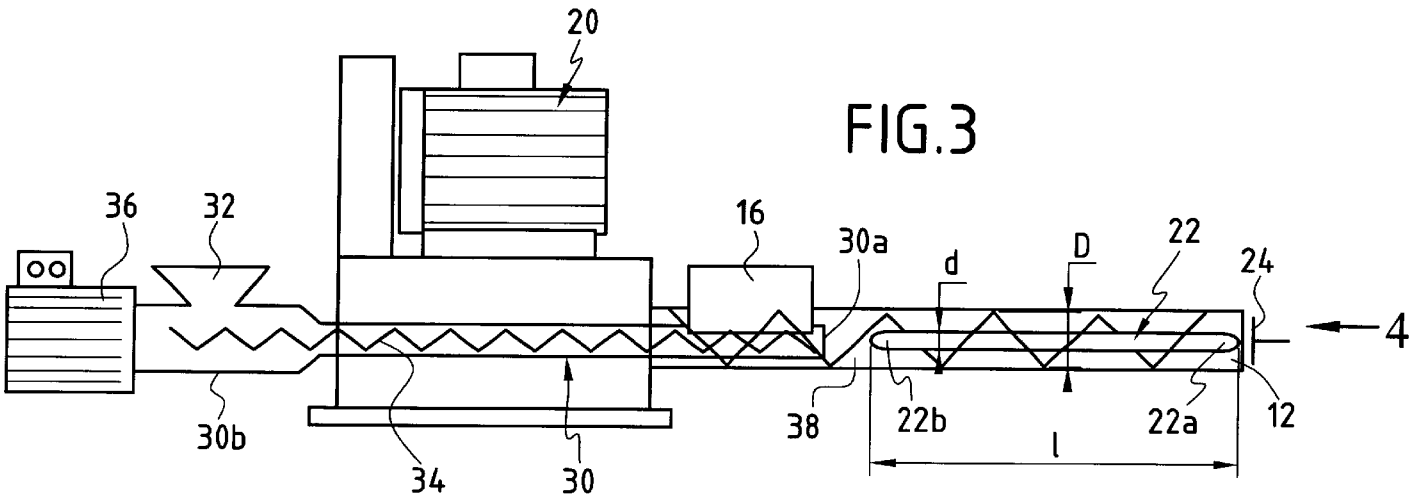
FIG. 3 shows a second form of embodiment of the mixer according to the invention.
Figure 5B:
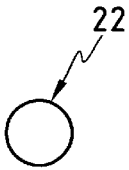
Figure 5A:
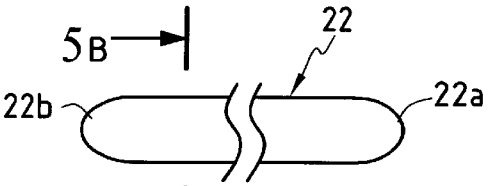
Figure 6B:
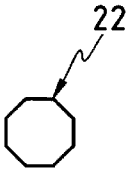
Figure 6A:
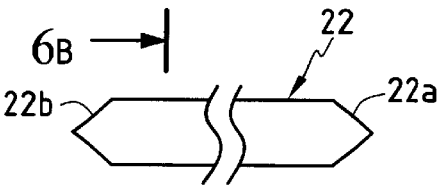
Figure 4:
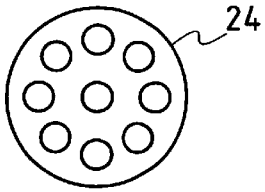
FIG. 4 shows a perforated plate at an end of a tubular casing included in the mixers of FIGS. 2–3, FIGS. 5A and 5B show, in longitudinal section and cross section, an elongated piece having the shape of ogives included in the mixers of FIGS. 2–3, and FIGS. 6A and 6B show, in longitudinal section and cross section, the elongated piece having the shape of cones included in the mixers of FIGS. 2–3.

FIG. 3 shows a second form of embodiment of the mixer. It differs from the one shown in FIG. 2 solely by the mode of infeed of the first product in the tubular casing 10.

This mixer comprises a second tube 30 of diameter smaller than that of the tubular casing 10. Its end 30*a* stops at the level of the device 16 for infeed of the second product to be mixed. Its second end 30*b* is widened and is provided with a hopper 32 for infeed of the first product. A second helix 34 for entraining the first product extends over the whole length of the second tube 30. The second helix is driven in rotation by a second motor 36. The mixing chamber 38 is therefore located between the end 30*a* of the second tube and the open end 12 of the first tubular casing 10. The cylindrical elongated piece 22, which is identical to that of FIG. 2, presents a length l which is less than the length of the mixing chamber 38. This second form of embodiment presents all the advantages of the first form of embodiment of FIG. 2.

What is claimed is:

1. Device for continuously mixing liquid products and/or pulverized products, comprising:

at least one outer tubular casing presenting a first end and a second end, means for supplying products to be mixed disposed at a first end of the tubular casing, the second end of the tubular casing being open for the discharge of the mixture, a mixer member having the form of a helix having an inner diameter D and an axial length L disposed inside the tubular casing, means for rotating the mixer member about the axis of said tubular casing, an elongated piece closed at its two ends, of diameter d, with d<D, and of length l less than said length L of the mixer member, said piece being mounted radially free inside the mixer member and being radially free with respect to said outer tubular casing to form an imbalance, and means for axially holding said cylindrical piece inside the mixer member.

2. The device of claim 1, wherein said holding means comprise a perforated plate disposed at the second, open end of said tubular casing.

3. The device of claim 1, wherein said ends of the elongated piece are shaped.

4. The device of claim 3, wherein said ends of the elongated piece present the shape of cones or of ogives.

5. The device of claim 3, wherein the diameter d of the elongated piece is included between 90% and 50% of the diameter D of the helix.

6. The device of claim 5, wherein said elongated piece presents a polygonal cross-section.

7. The device of claim 1, wherein said diameter d of the elongated piece is included between 90 and 50% of the diameter D of the helix.

8. The device of claim 1, wherein said elongated piece presents a substantially circular cross-section.

9. The device of claim 1, wherein said elongated piece presents a polygonal cross-section.

* * * * *

UNITED STATES PATENT AND TRADEMARK OFFICE

CERTIFICATE OF CORRECTION

PATENT NO. : 6,464,388 B2
DATED : October 15, 2002
INVENTOR(S) : Jean-Philippe Ligouzat It is certified that error appears in the above-identified patent and that said Letters Patent is hereby corrected as shown below:

Title page,
Item [75], Inventor, "Noisy le Roi" should read -- Noisy Le Roi --;
Item [73], Assignee, "Pari" should read -- PARI --; and Column 4,
Lines 48 and 53, "d" should read -- d --.

Signed and Sealed this

Eighteenth Day of November, 2003

JAMES E. ROGAN
*Director of the United States Patent and Trademark Office*